United States Patent [19]

Nieto et al.

[11] Patent Number: 4,721,267

[45] Date of Patent: Jan. 26, 1988

[54] MOUNTING ASSEMBLY FOR A ROLL OF MATERIAL

[75] Inventors: Robert L. Nieto, Concord; Joseph B. Camacho; David J. Devine, both of San Jose, all of Calif.

[73] Assignee: Benson, Inc., Mountain View, Calif.

[21] Appl. No.: 837,457

[22] Filed: Mar. 7, 1986

[51] Int. Cl.[4] ..... B65H 16/06; B65H 23/06

[52] U.S. Cl. ..... 242/68.4; 242/72.1; 242/75.4

[58] Field of Search ..... 242/68, 72.1, 75.4, 242/55.2, 58, 68.4, 129.6; 384/129

[56] References Cited

U.S. PATENT DOCUMENTS

| | | | |
|---|---|---|---|
| 892,287 | 6/1908 | Morse | 242/72.1 |
| 2,904,278 | 9/1959 | Riemenschnieder | 242/72.1 |
| 3,610,643 | 10/1971 | Thompson | 242/72.1 X |
| 3,734,424 | 5/1973 | Ulseth | 242/75.4 |
| 3,990,690 | 11/1976 | Lick | 242/72.1 X |
| 4,179,077 | 12/1979 | Morishita | 242/75.4 X |
| 4,483,491 | 11/1984 | Rainey | 242/55.2 |
| 4,553,710 | 11/1985 | Pool | 242/55.2 |
| 4,597,241 | 7/1986 | Clostermeyer | 242/75.4 X |

*Primary Examiner*—Stuart S. Levy

*Assistant Examiner*—Katherine Matecki

*Attorney, Agent, or Firm*—Theodore S. Park; Bruce D. Riter; James F. Hann

[57] ABSTRACT

An assembly for mounting a roll of paper or Mylar® film having a hollow core includes a radially expanding core insert at each end of the roll and a core insert support, mountable to a support structure, to support, position and apply a drag force to the paper roll. Each core insert has a radially expandable inner end which is expanded within the core to secure the insert in place. The outer end of the core insert extends beyond the edge of the paper roll. The core insert support includes a pair of arcuate contact surfaces and an adjustable spring biased brake shoe mounted to a frame. The brake shoe presses the outer end of the core insert against the contact surfaces to create a suitable drag on the paper roll. A flipper is pivotally mounted to the frame for movement between free movement and blocking positions to permit or prevent the core inserts from being removed from the core insert supports. Each flipper also axially biases the core insert towards the other flipper. One flipper presses on the paper roll substantially harder than the other so the paper roll is constantly biased to one side to aid proper positioning of the paper.

15 Claims, 3 Drawing Figures

MOUNTING ASSEMBLY FOR A ROLL OF MATERIAL

BACKGROUND OF THE INVENTION

The invention is related to apparatus for rotationally mounting rolls of material to a support structure, in particular apparatus for mounting rolls of paper or Mylar® film, in a printer/plotter.

Many materials are stored on and dispensed from rolls. The print media used by printer/plotters is often stored on a roll and is usually wrapped on a hollow spool or core. The core and print media are often the same width so that the ends of the core are flush with the ends of the print media. To enable the roll to be mounted to the printer/plotter, or other apparatus, a core adapter is often used. One type of core adapter includes plugs at each end coupled together by an elongate rod, typically threaded at each end, passing through the core and the plugs. The roll is then supported by the portions of the plugs extending past the ends of the core. This prior art approach is, however, cumbersome to use. Each time a new roll is to be used the old one must be removed, the plugs unthreaded and the rods removed. These actions require a large workspace—at least twice the length of the roll. Also, the prior art approach has a number of parts, some of which are small and subject to being misplaced.

When a material is dispensed from a roll, as it often is with commercially available printer/plotters, a braking force can be used to control the rotation of the roll to prevent it from free-wheeling and dispensing too much material. Braking forces also provide a tension on the material as it leaves the roll. The need to prevent free-wheeling of the paper roll and the need to provide the paper with an acceptable tension as it enters a printer/-plotter are very important considerations in the design of printer/plotters. The designer of mounting structures for rolls of material is therefore confronted with the seemingly mutually exclusive criteria of application of a proper braking force, ease of use by persons with minimal training, long life and reasonable cost.

SUMMARY OF THE INVENTION

The present invention is directed to a material roll mounting assembly constructed for simple and quick loading and unloading of the material roll, effective but simple braking of the roll and axial biasing of the roll toward one end. The mounting assembly includes a radially expandable core insert at each end of the roll and a core insert support assembly, mountable to a support structure, to support, position and apply a suitable drag force to the roll through the core inserts. The support structure is typically a portion of a machine in which the material is used. The core inserts each have a radially expandable inner end sized to be inserted into the core. The inner end of the core insert has a number of radially deflectable fingers which are biased radially outwardly by movement of a tapered plug within the inner end. The outer end of the core insert has a support surface extending beyond the edge of the paper roll.

The core insert is supported and positioned by the core insert support assembly which includes a frictional brake. The brake applies a frictional force to the support surface of the core insert. The frictional force preferably is adjustable so the frictional drag on the paper roll can be varied.

The outer ends of the core inserts are guided into engagement with the brake by a guide path having tapered or camming entrance end. A dual purpose flipper is mounted adjacent the guide path for movement between a free movement position, in which the core insert is free to move along the guide path, and a blocking position, in which the end of the flipper is positioned along the guide path to prevent the removal of the core insert from the core insert support assembly. The end of the flipper is configured to press against the outer edge of the core insert and axially bias the core insert towards the core insert support assembly at the other end of the roll. The biasing force of one of the flippers is substantially greater than that of the other flipper so the paper roll is always biased to one side to aid in the proper positioning of the paper as it enters the printer/plotter.

One of the features of the invention is the ease by which the user can mount and dismount a roll of, for example, paper or Mylar® film into and from the printer/plotter. Installing the roll simply requires the user to align the core inserts at the ends of the roll with the tapered guide paths and push. This action pushes the flippers back out of the guide paths until the core inserts pass the flippers. The flippers then move back into the guide paths to prevent the accidental removal of the roll. Removing a roll, or its core, is nearly as easy: the user presses back the flippers and pulls out the roll. If needed, the flippers can be temporarily restrained to the free-movement position for ease of removal. The core inserts are then removed from the empty roll and inserted into a new roll.

Another feature is the reliable but effective construction of the brake. The support surface of the core insert at each end of the paper roll is positioned between, for example, two convex contact surfaces. A biasing force, provided by a brake shoe in the preferred embodiment, presses on the support surface of the core insert in a direction passing between the two contact surfaces. Thus the force from the brake shoe, in addition to providing a retarding or drag force, helps keep the paper roll in position.

A further feature of the invention is related to its dual function flipper. The outer end of the flipper has two operating surfaces. When the flipper is in the blocking position with its outer end positioned along the guide path, one surface presses axially against the outer edge of the core insert while the other surface, transverse to the biasing surface, keeps the paper roll from accidentally falling out of the machine.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
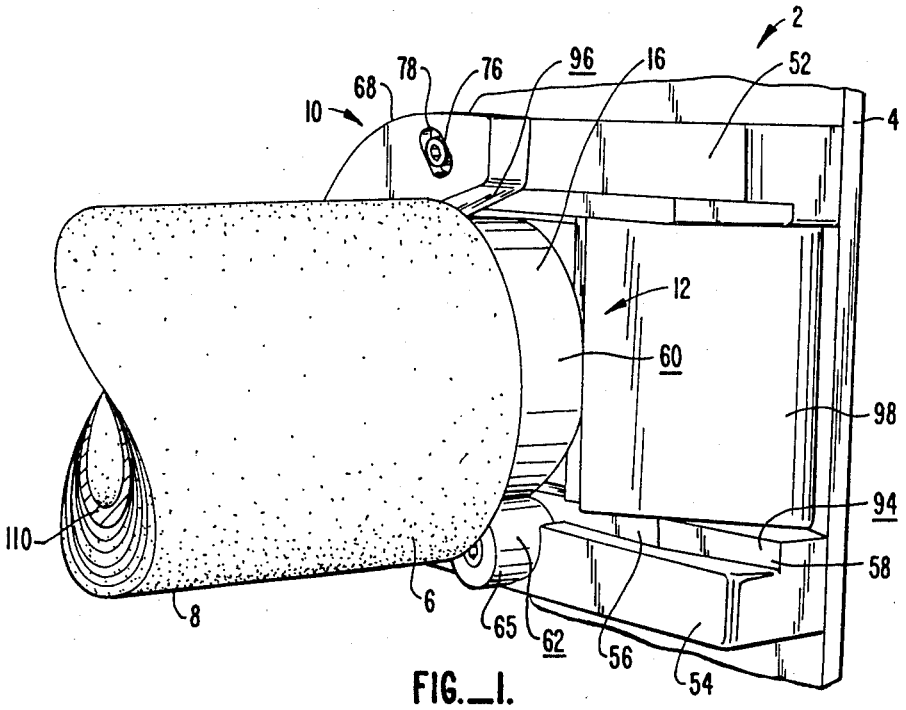
FIG. 1 is a perspective view showing a paper roll mounting assembly of the invention mounted to a support structure and supporting one end of a paper roll.

Referring now to the figures, a paper roll mounting assembly 2 is shown mounted to a support structure 4, typically part of a printer/plotter, and housing an end 6 of a paper roll 8. Mounting assembly 2 includes a core insert support assembly 10 and a core insert assembly 12. Support assembly 10 is for use with the right hand end 6 of paper roll 8. The left hand support assembly, not shown, is a mirror image of the right hand support assembly 10 and therefore will not be described in detail.

Figure 2:
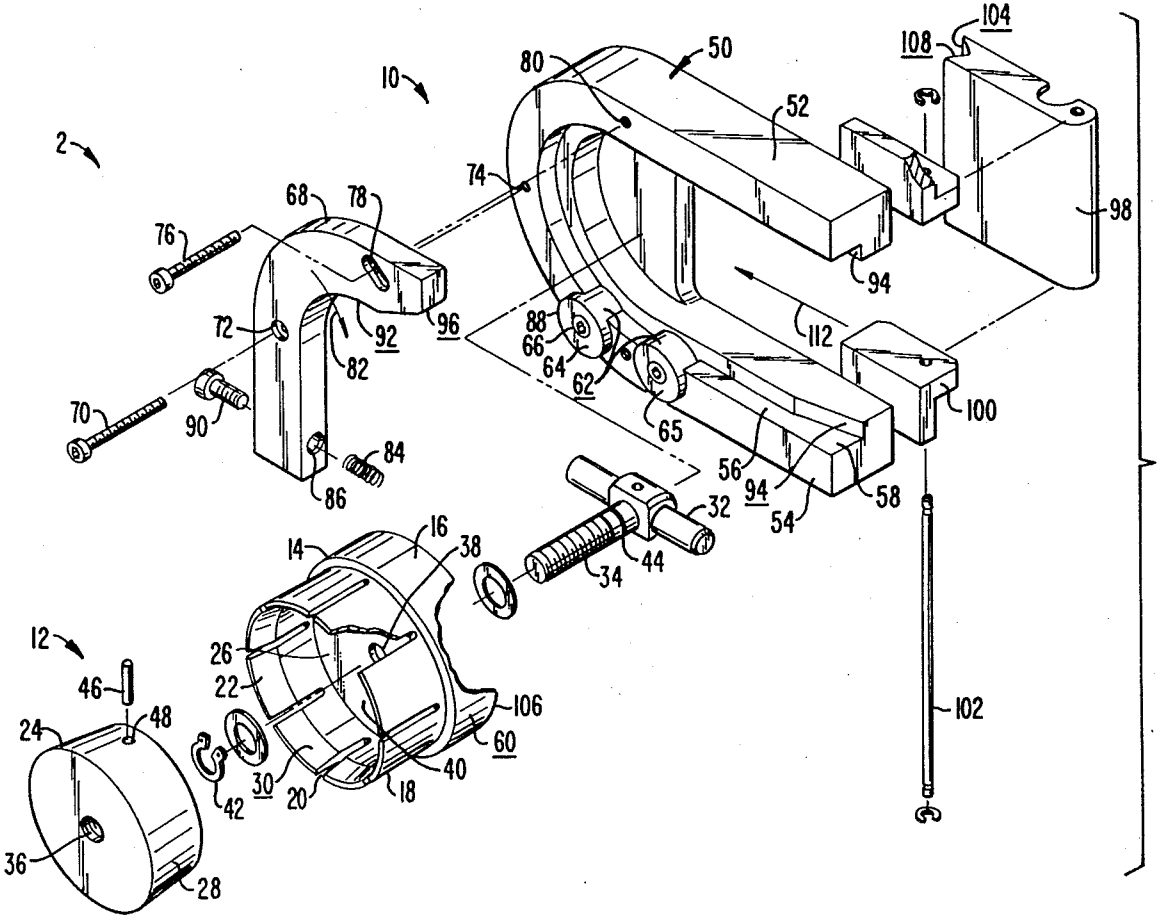
FIG. 2 is an exploded isometric view of the paper roll mounting assembly of FIG. 1.

As shown in FIG. 2, core insert assembly 12 includes a generally cylindrical core insert 14 including an enlarged, cylindrical outer end 16 and a reduced diameter inner end 18, the inner end having a number of axial slots 20 to create a number of fingers 22. A plug 24 is mounted within the interior 26 of inner end 18 and has a tapered outer surface 28 which engages a similarly tapered inner surface 30 of inner end 18. A T-bar handle 32 has a threaded shaft 34 which engages a threaded bore 36 in plug 24. Shaft 34 passes through an opening 38 in bulkhead 40. Bulkhead 40 is positioned approximately in the middle of core insert 14.

T-bar handle 32 is kept in position by the engagement of a split ring 42 within a groove 44 on shaft 34. This keeps handle 32 from moving axially while it is rotated by the user to draw plug 24 into interior 26 of inner end 18 (to expand fingers 22) or to drive plug 24 from interior 26 (to allow fingers 22 to retract). A pin 46 is mounted partially within a hole 48 extending in a radial direction from tapered outer surface 28. Pin 46 extends into one of the slots 20 to keep plug 24 from rotating with shaft 34 when T-bar handle 32 is rotated.

Figure 3:
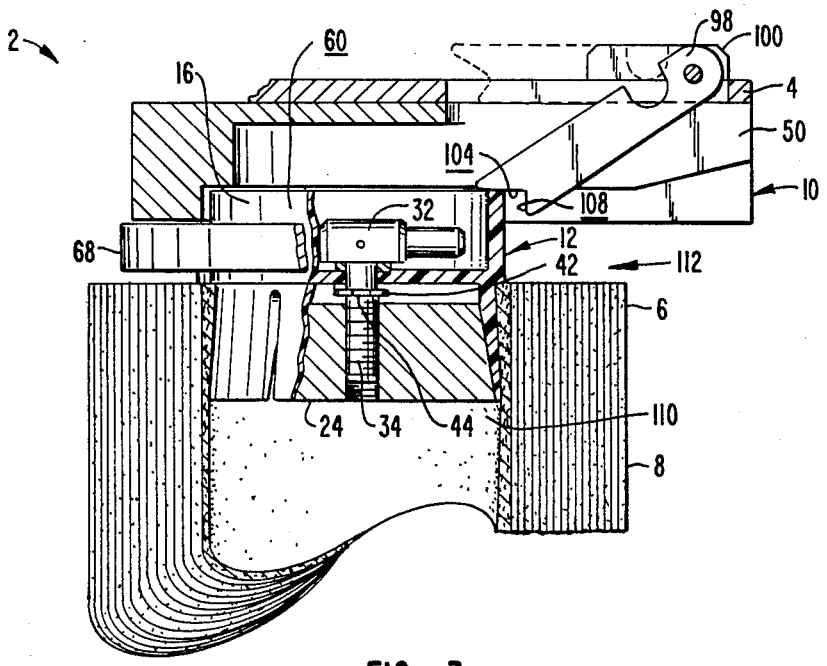
FIG. 3 is a top view of the assembly of FIG. 1 with portions broken away for clarity.

Core insert support assembly 10 includes a frame 50 mounted to support structure 4. Structure 4 is typically a portion of the printer/plotter or other apparatus within which the paper is to be used. Frame 50 includes upper and lower legs 52, 54 defining core insert guide paths 56. Each guide path 56 is sized to guide the outer support surface 60 of outer end 16 of core insert 14 as it moves from an entrance 58 of guide path 56 to the operation or use position shown in FIGS. 1 and 3. At such position surface 60 rests upon the circular contact surfaces 62 of a pair of cylindrical inserts 64, 65.

To keep paper roll 8 from free wheeling when the paper is unrolled and to provide a proper drag on the paper roll, a brake shoe 68 is used. Brake shoe 68 is pivotally mounted to frame 50 by a pivot screw 70 passing freely through a clearance hole 72 in brake shoe 68 and engaging a threaded hole 74 in frame 50. To limit the pivotal movement of brake shoe 68, a limit screw 76 is used; screw 76 passes through a pivot slot 78 and threadably engages a threaded hole 80 in frame 50. Brake shoe 68 is biased in the direction of an arrow 82 by a compression spring 84. One end of spring 84 is captured within an opening 86 in brake shoe 68 while the other is housed within a blind hole (not shown) in insert 64 at position 88. The force of spring 84 is adjusted by an adjustment screw 90 so to increase or decrease the frictional force applied by brake shoe 68 on core insert 14 as a braking surface 92 of brake shoe 68 rubs against support surface 60 of core insert 14. Guide paths 56 are tapered or cammed at their entrance ends 58 by tapered surfaces 94. This helps to guide core insert 14 into guide paths. Also, a camming surface 96 adjacent braking surface 92 helps guide core insert 12 to the operational position of FIGS. 1 and 3 so as to be in contact with surfaces 62 of inserts 64, 65 and braking surface 92 of brake shoe 68.

Inserts 64, 65 are mounted to frame 50 so that they do not rotate. If necessary, for example if surface 62 of insert 65 begins to wear, screw 66 mounting insert 65 to frame 50 can be loosened allowing insert 65 to be rotated slightly thus exposing a new contact surface 62. Insert 64 is usually not rotated because one end of spring 84 is in the blind hole in insert 64.

A dual function flipper 98 is mounted to support structure 4 by a pair of flipper mounting brackets 100 using a mounting pin 102. Flipper 98 is biased towards its operational or blocking position, shown in solid lines in FIG. 3, by a spring (not shown). Flipper 98 has a biasing surface 104 which rests against an outer edge 106 of outer end 16 of core insert 14. Since the left hand support assembly, not shown, is a mirror image of right hand support assembly 10 shown in FIGS. 1–3, the flippers 98 of each press paper roll 8 towards each other. However, one of the flippers 98 has a spring which is substantially stronger than the other so that paper roll 8 is axially biased in one direction. This aids proper registration of the paper as it passes through the printer/plotter, especially when the paper must make multiple passes through the printer/plotter or when the printer/plotter uses multiple printing stations.

Flipper 98 includes a blocking surface 108 positioned transverse to biasing surface 104. Blocking surface 108 intersects a part of path 56 so to prevent the inadvertent removal of paper roll 8 from support assembly 10. To remove paper roll 8 one needs merely pivot each flipper 98 from its solid line position of FIG. 3 to the dashed line position of FIG. 3. This can be done in several ways. For example, if paper roll 8 is quite long, one person can stand at each end of the paper roll, depress a flipper 98 and remove end 6 of the paper roll. Alternatively, the user can pivot flippers 98 out of the way, pin them in place in a conventional manner and then remove the paper roll.

To load the roll of paper, the user first places inner end 18 of core insert 14 into the open ended core 110 of paper roll 8. T-bar handle 32 is then rotated to draw plug 24 into interior 26 so to spread fingers 22 against core 110 thus securing core insert 14 in place. After this is done at both ends 6 of paper roll 8, the paper roll is mounted to core insert support assemblies 10 by placing outer ends 16 at entrances 58 of guide paths 56 and pushing paper roll 8 inwardly in the direction of an arrow 112 towards contact surfaces 62 and brake shoes 68. Initial movement of paper roll 8 is guided by tapered surfaces 94 which in effect act as camming surfaces at the entrances 58 of guide paths 56. During this inward movement in the direction of arrow 112, flippers 98 are biased out of the way by core inserts 14. Once support surfaces 60 at the outer ends 16 of core inserts 14 rest against contact surfaces 62, and braking surfaces 92 of brake shoes 68 press against support surfaces 60, a drag force hindering the free wheeling rotation of paper roll 8 is created. When roll 8 is in the operational position of FIGS. 1 and 3, flippers 98 rotate back to press against outer edges 106 and also block the inadvertent removal of paper roll 8.

Modifications and variations can be made to the preferred embodiment without departing from the subject of the invention as defined in the following claims. For example, instead of a pair of convex contact surfaces 62, a single concave contact surface may be used. In the preferred embodiment contact surfaces 62 support paper roll 8 as well as provide frictional resistance to turning. If desired inserts 64, 65 could be replaced by rotational bearings so that all frictional resistance is provided by braking surfaces 92 of brake shoes 68. Additionally, the preferred embodiment flippers 98 are indirectly mounted to frame 50 through brackets 100 and support structure 4. If desired flippers 98 could be mounted directly to frame 50. In some cases roll 8 will not have a core 110; the invention could be used in this circumstance as well. Also, if desired only one flipper 98 can be used to bias paper roll 8 towards the opposite support assembly 10. Support assemblies may be used without insert assemblies; in such cases roll 8 would be supported by its outer surface and the drag force would be applied directly to the outer surface of the roll.

We claim:

1. A material roll mount, for use at at least on end of a roll of material, for supporting the roll at a support structure, comprising:

a frame mountable to the support structure;

the frame defining a guide path for directing movement of the end of the material roll between a first position at an entrance of the guide path and a second position along the guide path;

a material roll contact surface for engagement with a chosen, external circumferential surface of the material roll when said roll end is at the second position;

means for biasing the chosen surface of the material roll against the contact surface to create a drag force on the material roll to retard rotational motion thereof;

a pivotal flipper, separate from the contact surface and positioned along the guide path and mounted for movement between a free movement position and a blocking position, for blocking movement of the material roll end from the second position to the first position when in the blocking position and for permitting movement of the material roll end from the second position to the first position when in the free movement position;

means for biasing the flipper towards the blocking position; and the flipper contacting the axially facing end of the material roll to supply an axial force on the material roll due to the biasing means when the flipper is in the blocking position.

2. The mount of claim 1 wherein the contact surface vertically supports the material roll.

3. The mount of claim 1 wherein the contact surface is a sliding surface against which the chosen surface rubs when the material roll rotates.

4. The mount of claim 1 wherein the contact surface is mounted directly to the frame.

5. The mount of claim 1 wherein the contact surface is an arcuate surface.

6. The mount of claim 1 wherein the contact surface includes first and second surface segments.

7. The mount of claim 6 wherein the chosen surface biasing means biases the material roll chosen surface in a direction which passes between the first and second surface segments.

8. The mount of claim 7 wherein the first and second surface segments are arcuate.

9. The mount of claim 1 wherein the entrance of the guide path is tapered to guide the material roll end upon entering the guide path.

10. The mount of claim 1 wherein the chosen surface biasing means includes a brake shoe having an arcuate surface for sliding engagement with the material roll end to provide a drag force thereon.

11. The mount of claim 10 wherein the brake shoe is pivotally mounted to the frame.

12. The mount of claim 11 further comprising means for limiting the pivotal movement of the brake shoe.

13. A print media roll mounting assembly for use at at least one end of a roll of print media to mount the print media roll to a support structure, the print media roll of the type having an outer circumference, end surfaces and a hollow core with open ends, the assembly comprising:

first and second core inserts, each manipulable between expanded and retracted conditions, each including a radially expandable first portion insertable within the open end of the hollow core when in the retracted condition;

first and second means for radially expanding the first ends of the first and second core inserts so to secure the core inserts within the hollow core;

the core inserts each including a second portion positioned external of the hollow core; and first and second insert support assemblies, mountable to the support structure, for rotatably supporting the second portions of the core inserts, each core insert support including:

a frame;

the frame defining a guide path for directing movement of the print media roll between a first position at an entrance of the guide path and a second position along the guide path;

a core insert contact surface for engagement with the second portion of the core insert when the print media roll is at the second position;

means for biasing the second portion of the core insert against the contact surface to create a drag force on the core insert retarding rotational motion of the core insert and print media roll therewith;

a flipper, positioned along the guide path and movable between a free movement position and a blocking position, for blocking movement of the core insert and print media roll therewith from the second position to the first position when in the blocking position and for permitting movement of the core insert and print media roll therewith from the second position to the first position when in the free movement position, the flipper including a core insert edge contact portion;

means for biasing the flipper towards the blocking position so the core insert edge contact portion applies an axially directed force to the print media roll so the flippers of the first and second insert support assemblies bias the print media roll toward each other when in the blocking position.

14. The assembly of claim 13 wherein the flipper biasing means for the flippers of the first and second insert support assemblies produce first and second forces on the print media roll end surfaces, the first force being substantially greater than the second force.

15. The assembly of claim 13 wherein the core insert contact surface is a stationary surface.

* * * * *